US009241582B2

(12) United States Patent
Gilboa et al.

(10) Patent No.: US 9,241,582 B2
(45) Date of Patent: Jan. 26, 2016

(54) BABY AND TODDLER CARRIER

(75) Inventors: Galit Gilboa, Moshav Salit (IL); Ronit Bachar, Raanana (IL)

(73) Assignee: Galit Gilboa et al., Moshav Salit (IL)

( * ) Notice: Subject to any disclaimer, the term of this patent is extended or adjusted under 35 U.S.C. 154(b) by 347 days.

(21) Appl. No.: 11/993,877

(22) PCT Filed: Jun. 26, 2006

(86) PCT No.: PCT/IL2006/000745

§ 371 (c)(1),
(2), (4) Date: Dec. 25, 2007

(87) PCT Pub. No.: WO2007/000762

PCT Pub. Date: Jan. 4, 2007

(65) Prior Publication Data

US 2009/0101683 A1 Apr. 23, 2009

Related U.S. Application Data

(60) Provisional application No. 60/693,788, filed on Jun. 27, 2005.

(51) Int. Cl.
*A47D 13/02* (2006.01)

(52) U.S. Cl.
CPC ..... *A47D 13/025* (2013.01); *A41D 2400/482* (2013.01)

(58) Field of Classification Search
CPC ..... A47D 13/00; A47D 13/02; A47D 13/025; A47D 13/107; A47D 15/008; A47D 15/006; A41D 2400/482; A45F 3/14; A45F 3/04
USPC ..... 224/158, 159, 160, 161, 642, 643; D3/213, 214
See application file for complete search history.

(56) References Cited

U.S. PATENT DOCUMENTS

| | | | | | |
|---|---|---|---|---|---|
| 1,196,003 | A | * | 8/1916 | Lippincott | 224/159 |
| 4,009,808 | A | * | 3/1977 | Sharp | 224/160 |
| 4,139,131 | A | * | 2/1979 | Hathaway | 224/160 |
| 4,434,920 | A | * | 3/1984 | Moore | 224/160 |
| 4,487,346 | A | | 12/1984 | Fischer, Jr. | |
| 5,178,309 | A | | 1/1993 | Bicheler et al. | |
| 5,181,638 | A | * | 1/1993 | McHale | 224/637 |
| 5,205,450 | A | | 4/1993 | Derosier | |
| 5,551,614 | A | * | 9/1996 | Ham | 224/264 |
| D394,546 | S | * | 5/1998 | Svendsen et al. | D3/214 |
| 5,848,741 | A | | 12/1998 | Fair | |

(Continued)

FOREIGN PATENT DOCUMENTS

| | | |
|---|---|---|
| DE | 29617217 | 3/1997 |
| EP | 1055382 | 11/2000 |

(Continued)

*Primary Examiner* — Adam Waggenspack
*Assistant Examiner* — Matthew Theis
(74) *Attorney, Agent, or Firm* — Marc Van Dyke; Fourth Dimension IP

(57) ABSTRACT

The present invention relates to a baby and toddler carrier and in particular to a novel and improved baby and toddler carrier to be used by a parent or other caretakers for carrying a baby in a secure and comfortable way, both for the adult and for the baby, in various carrying positions, the carrier includes an elastic back and neck support, harness straps, and buckles, all of which enable carrying the baby in at least five different carrying positions.

22 Claims, 12 Drawing Sheets

(56) References Cited

U.S. PATENT DOCUMENTS

| | | | | |
|---|---|---|---|---|
| 6,045,018 | A | 4/2000 | Onishi | |
| 6,257,468 | B1 | 7/2001 | Yamazoe et al. | |
| 6,397,783 | B1 | 6/2002 | Koch | |
| 6,415,969 | B1 | 7/2002 | Higuchi | |
| 6,520,391 | B2 | 2/2003 | Yen | |
| 6,598,771 | B2 * | 7/2003 | Norman | 224/160 |
| 6,802,442 | B1 * | 10/2004 | Thompson | 224/637 |
| 7,168,600 | B2 * | 1/2007 | Hwang | 224/155 |
| 2004/0155078 | A1 | 8/2004 | Hwang | |
| 2005/0051582 | A1 * | 3/2005 | Frost | 224/160 |
| 2005/0189386 | A1 * | 9/2005 | Mortell | 224/160 |
| 2005/0242136 | A1 | 11/2005 | Moriguchi et al. | |

FOREIGN PATENT DOCUMENTS

| | | | |
|---|---|---|---|
| FR | EP 1665959 | 12/2005 | |
| GB | 2224635 | 5/1990 | |
| SE | WO03003880 | 1/2003 | |
| WO | WO02/07546 | 1/2002 | A41B 13/06 |
| WO | WO2005/025383 | 3/2005 | |

* cited by examiner

BABY AND TODDLER CARRIER

FIELD AND BACKGROUND OF THE INVENTION

The present invention relates to a baby and toddler carrier and in particular to a novel and improved baby and toddler carrier to be used by a parent or other caretakers for carrying an infant, a baby or child, in a secure and comfortable way, both for the adult and for the baby, in various carrying positions.

As used herein the specification and in the claims section that follows, the term "baby" and the like refer to a human being of a substantially small weight suitable for carrying in a carrier according to the present invention, including an infant, a baby or child.

From the dawn of humanity, parents and other adults carry babies. The first natural form of carrying is in one's arms, with the newborn baby cradled in his mother or father's arms, then in various carriers, made of different fabrics and methods of use, in order to let the mother continue working while carrying the baby. Thus one can see a mother working in the field, while carrying her baby on her back, wrapped in a piece of fabric carried on their chest or on their shoulders.

In western/modern society, seeing as in many cases the adult carrying the baby needs to perform various tasks for which he needs his hands and/or front portion of the body to be free, as well as for comfort purposes, over the years many various types of carriers were developed to enable carrying babies for a long period of time while leaving the carrying adult's hands and/or front portion of the body free.

The modern carriers available on the market today enable adults to carry babies in front, on their backs, or on the side with the babies seated on the adults' waists.

An example of a common way of carrying a baby 300 in front of an adult 400 is shown in FIG. 1*a*, and on the back of an adult 400 is shown in FIG. 1*b*.

The carrying is by means of a carrier 100 which is a soft carrier belonging to the group of carriers known as wrap carriers, usually composed from one long strip of fabric or several long strips of fabric wrapping the baby and adult together.

Carrying a baby in a wrap carrier has several advantages which are the result of the baby resting snugly against the carrying adult. This way, the baby can feel the rhythm of the adult's beating heart and his center of gravity is close to the adult, thus avoiding a moment (moment is the product of a force and the distance from its action to a point) that makes carrying more difficult. However, wrap carriers also have disadvantages, including the difficulty of carrying a heavy baby, the sometimes uncontrolled pressure that the carrier applies to the baby, and the complicated preparations for carrying. Use on the back is especially difficult since it's virtually impossible to be worn independently, with no help.

Western society has created carriers which are more structured and upholstered, designed mainly for front use. In most of these carriers the carrier is worn by the adult prior to putting the baby inside.

Advantages of this group of carriers, known as front upholstered carriers, include them being relatively easy to wear. They free the adult's hands and are good for carrying a newborn baby close to the parent while maintaining eye contact in the first few months. In addition the baby can be positioned with his face outward.

Front upholstered carriers are schematically illustrated in FIG. 2*a*. The illustration shows two adults, each carrying a front upholstered carrier 200 with a baby 300 carried in front, one of whom is face to face with the baby 300 while the other baby 300 is facing outward and his back is to adult 400 who is carrying him.

This group of carriers has the prominent disadvantage of being mostly designed for front use, thus having the difficulty of carrying a heavy baby in front, which is heavy on the adults' backs. This group of carriers keeps the hands of the adult free but the front portion of the adult's body is still obstructed and thus does not allow many of the daily chores to be done comfortably.

An additional group of modern carriers are backpack carriers with plastic or aluminum frame. An example of a backpack carrier is schematically illustrated in FIG. 2*b*. Backpack carrier 201 includes a baby seat 200*a* and a waist belt 200*b* including straps and accessories enabling carrying backpack carrier 201 with baby 300 inside, on the shoulders and waist of adult 400. In this carrier, the baby 300 is at a considerable distance from the back of the carrying adult 400.

A prominent advantage of the backpack carrier is a result of the use of a waist belt, achieving controlled distribution of the pressures applied by the carrier on the adult who is carrying. Another advantage which makes the carrier easy to use is the fact that the baby is loaded in the carrier prior to it being lifted. These developments of carriers introduce additional accessories attached such as headrest, bag, shade etc.

However, the backpack carrier also has its disadvantages, such as the distance between the baby and the adult, preventing the baby from feeling the rhythm of the adult's heartbeat and causing a moment that makes carrying difficult and putting pressure on the adult's back and neck. An additional disadvantage is the age limitation. The carrier suits only babies who can sit well from the age of 6-8 months, and cannot be worn in front. This kind of carrier is mostly large and rigid and therefore is mainly for outdoor use.

Despite the many developments in the field of carriers, not all possibilities have been exhausted, and there is thus a widely recognized need for, and it would be highly advantageous to have a further developed carrier. A carrier that facilitates caretakers' preparation of the baby for carrying, carrying the baby, and removing him from the carrier in a more efficient, convenient, and safe way for the baby and adult than is currently available. It is highly advantageous to have a carrier that enables daily use by keeping the front of the body unobstructed, a carrier which is lightweight with no construction. Furthermore, it would be highly advantageous to use one single carrier which is "one-size" for babies and adults, suitable for carrying children from infancy through toddlerhood, and adjustable for different sizes of adults.

SUMMARY OF THE INVENTION

A baby carrier according to the present invention is suitable for holding infants, babies and children, starting from full term baby up until a weight of approximately 18 kg. The carrier is designed to be worn in front, or alternatively, on the back of an adult. The carrier is designed as "one size", fitting babies of all sizes and adjustable for a wide range of adult sizes.

A baby carrier according to the present invention is designed and manufactured according to a novel combination of the design of wrap carriers, front upholstered carriers and backpack carriers, resulting in a lightweight and very safe carrier, which enjoys the advantages of all groups of carriers, including the close proximity of the baby to the adult when being carried, the superior weight distribution on the adult's body, and extreme convenience in use of the carrier.

The carrier according to the present invention also includes an arrangement of harnesses and surfaces, creating a type of container to hold the baby, imitating the "piggy back ride" position of the adult holding a baby or baby in front or on the back, while supporting the baby's behind and thighs with his hands, with the baby's legs clasping the adults waist. The carrier according to the present invention spares the need for using hands. There are at least five ways to carry the baby in the carrier according to the present invention:

First way: on the back of an adult, with the baby in position with legs pointing down;

Second way: on the back of an adult, with the baby in position with legs spread, in a "piggy back ride" position.

Third way: in front of an adult, with the baby facing the adult in position with legs pointing down.

Fourth way: in front of an adult, with the baby facing the adult with legs spread, around the adults waist; and Fifth way: in front of an adult, with the baby facing outward with legs pointing down.

The baby or child is secured in the baby carrier according to the present invention, prior to being strapped onto the adult, while the structure, according to the present invention, allows the baby carrier to be worn easily and independently, as well as to be taken off for short intervals, for purposes such as breastfeeding, with no need to take the baby out of the carrier, and simply leaving the baby in the carrier for feeding.

The baby carrier according to the present invention is structured so that it gives a secure and adjustable space for babies and toddlers. The baby carrier is a "one-size" carrier allowing the baby to grow and develop while using the same carrier. When the baby is very small his hands are positioned inside the baby carrier, in front of his chest, resembling a fetus, and then when older he can stretch his hands out. The baby eventually comes to keep his hands out.

Materials that can be used in the baby carrier also include: cloth, polyethylene foam padding in various thicknesses, ventilation sheets, acrylic tubes locking and tensioning buckles, knitted adjustment straps, and laces.

The baby carrier can be fabricated by sewing and gluing.

According to the teachings of the present invention there is provided a baby carrier for enabling a caretaker for carrying a baby in a secure and comfortable way, in various carrying positions, the baby carrier including: a back and neck support having a symmetrical form; a first baby crotch harness having a first end and a second end, wherein the first end of the first baby crotch harness is disposed at the back and neck support; and a second baby crotch harness having a first end and a second end, wherein the first end of the second baby crotch harness is disposed at the back and neck support; wherein the first baby crotch harness and the second baby crotch harness have a split form.

According to still further features in the described preferred embodiments the baby carrier further including: further comprising: a first connection strap disposed at the second end of the first baby crotch harness; a second connection strap disposed at the second end of the second baby crotch harness; a first adjustment buckle disposed at the first connection strap; a second adjustment buckle disposed at the second connection strap; a first adjustment strap having a first end and a second end, wherein the first adjustment strap passes through the first adjustment buckle; a second adjustment strap having a first end and a second end, wherein the second adjustment strap passes through the second adjustment buckle; and a baby leg holder having a first end and a second end, wherein the first end of said baby leg holder is disposed at the first end of the first adjustment strap, and wherein the second end of the baby leg holder is disposed at the first end of the second adjustment strap.

According to still further features in the described preferred embodiments, the baby carrier further including: a first lace loop disposed at the second end of the first adjustment strap; and a second lace loop disposed at the second end of the second adjustment strap.

According to still further features in the described preferred embodiments, the baby carrier further including: a first tubular shoulder pad disposed at the second end of the first baby crotch harness; a second tubular shoulder pad disposed at the second end of the second baby crotch harness; a first side harness having a triangle shape, wherein one side of the first side harness is disposed at the back and neck support, and wherein one vertex of the first side harness is disposed at the first tubular shoulder pad; and a second side harness having a triangle shape, wherein one side of the second side harness is disposed at the back and neck support, and wherein one vertex of the second side harness is disposed at the first tubular shoulder pad.

According to still further features in the described preferred embodiments, the baby carrier further including: a baby adjustment and locking strap assembly including: a first baby security belt disposed at the back and neck support; a second baby security belt disposed at the back and neck support; a buckle disposed at the first baby security belt; and a latch disposed at the second baby security belt; an adult adjustment and locking buckle assembly including: a first adult chest security belt disposed at the first tubular shoulder pad; a second adult chest security belt disposed at the second tubular shoulder pad; a buckle disposed at the first adult chest security belt; and a latch disposed at the second adult chest security belt.

According to still further features in the described preferred embodiments, the baby carrier, wherein the back and neck support includes: a casing, having internal volume; and an elastic filling disposed at the internal volume of the casing; wherein the elastic filling operatively carries the bending loads applied on the baby carrier, and wherein the back and neck support have dimensions enabling the baby to keep his hands inside when small and extend his arms when older, outside of the baby carrier.

According to still further features in the described preferred embodiments, the baby carrier, wherein the first baby crotch harness and the second baby crotch harness are composed of at least one layer of fabric, and is padded, having a sufficient capacity for stretching loads as necessary for suitable safety qualities of the baby carrier.

According to still further features in the described preferred embodiments, the baby carrier, wherein the first tubular shoulder pad and the second tubular shoulder pad have a lower ends and have walls, wherein each of the tubular shoulder pads has a first opening in the lower end, and wherein each of the tubular shoulder pads has a second opening in the wall.

According to still further features in the described preferred embodiments, the baby carrier including no metallic construction, no plastic construction, and no composite materials construction.

According to still further features in the described preferred embodiments, the baby carrier, wherein the baby leg holder has a baby leg holder padded margin, wherein the baby leg holder has a width dimension, wherein the baby leg holder is composed of a material suitable for folding, and wherein the folding capability enables temporarily changing the width dimension.

According to another embodiment of the invention there is provided a universal padding to be used by humans that suits the varying shoulder curves of humans, gives a circumferential padding to soften contact beneath the armpit, the universal padding including: a tubular shoulder pad wherein the tubular shoulder pad has a lower end and has walls, wherein the tubular shoulder pads has a first opening in the lower end, wherein the tubular shoulder pad has a second opening in the wall; and an adjustment strap, having a first end and a second end, wherein the adjustment strap is disposed within the tubular shoulder pad, wherein the first adjustment strap end emerges from the tubular shoulder pad first opening, and wherein the second adjustment strap end emerges from the tubular shoulder pad second opening.

According to still further features in the described preferred embodiments, the universal padding further including: a connecting strap disposed at the tubular shoulder pad; and an adjustment buckle disposed at the connection strap, wherein the adjustment strap is passes through the adjustment buckle.

According to the present invention there is provided a method of carrying a baby by an adult, including the step of: providing a baby carrier including: a back and neck support having a symmetrical form; a first baby crotch harness having a first end and a second end, wherein the first end of the first baby crotch harness is disposed at the back and neck support; a second baby crotch harness having a first end and a second end, wherein the first end of the second baby crotch harness is disposed at the back and neck support; wherein the first baby crotch harness and the second baby crotch harness have a split form; a first connection strap disposed at the second end of the first baby crotch harness; a second connection strap disposed at the second end of the second baby crotch harness; a first adjustment buckle disposed at the first connection strap; a second adjustment buckle disposed at the second connection strap; a first adjustment strap having a first end and a second end, wherein the first adjustment strap is passes through the first adjustment buckle; a second adjustment strap having a first end and a second end, wherein the first adjustment strap is passes through the second adjustment buckle; a baby leg holder having a first end and a second end, wherein the first end of the baby leg holder is disposed at the first end of the first adjustment strap, and wherein the second end of the baby leg holder is disposed at the first end of the second adjustment strap; a first tubular shoulder pad disposed at the second end of the first baby crotch harness; a second tubular shoulder pad disposed at the second end of the second baby crotch harness; a first side harness having a triangle shape, wherein one side of the first side harness is disposed at the back and neck support, and wherein one vertex of the first side harness is disposed at the first tubular shoulder pad; a second side harness having a triangle shape, wherein one side of the second side harness is disposed at the back and neck support, and wherein one vertex of the second side harness is disposed at the first tubular shoulder pad; and a baby adjustment and locking strap assembly including: a first baby security belt disposed at the back and neck support; a second baby security belt disposed at the back and neck support; a buckle disposed at the first baby security belt; and a latch disposed at the second baby security belt; an adult adjustment and locking buckle assembly including: a first adult chest security belt disposed at the first tubular shoulder pad; a second adult chest security belt disposed at the second tubular shoulder pad; a buckle disposed at the first adult chest security belt; and a latch disposed at the second adult chest security belt, wherein the back and neck support includes: a casing, having internal volume; and an elastic filling disposed at the internal volume of the casing; wherein the elastic filling operatively carries the bending loads applied on the baby carrier, and wherein the back and neck support have dimensions enabling the baby to extend his arms outside of the baby carrier, wherein the first tubular shoulder pad and the second tubular shoulder pad have lower ends and have walls, wherein each of the tubular shoulder pads has a first opening at the lower end, and wherein each of the tubular shoulder pads has a second opening at the wall, and wherein the baby leg holder has a baby leg holder padded margin, wherein the baby leg holder has a width dimension, wherein the baby leg holder is composed of a material suitable for folding, and wherein the folding capability enables to temporarily changing the width dimension.

According to the present invention the method further includes the steps of: spreading the baby carrier open, with the baby leg holder and the tubular shoulder pad spread to the sides; positioning the back of the baby's and the lower half of his head on the back and neck support; passing the baby crotch harness between the legs of the baby; closing the baby adjustment and locking strap assembly, and tightening it until the baby is comfortably secured; lifting the baby carrier to the adult's chest; and carrying the baby carrier in front of the adult.

According to the present invention the method further includes the steps of: grasping the first tubular shoulder pad by the adult; grasping the second tubular shoulder pad by the adult; the adult standing up and adjusting and locking the adult adjustment and locking strap buckle assembly; folding outwards the baby leg holder and ensuring that the baby's legs is pointing downwards; and carrying the baby carrier on the back of the adult.

According to the present invention the method further includes the steps of: loading the baby carrier with a baby; carrying the baby carrier on the adult, with the baby in position with legs pointing down; carrying the baby carrier on the back of the adult, with the baby in position with legs spread; carrying the baby carrier in front of the adult, with the baby facing the adult in a position with the baby's legs pointing down; carrying the baby carrier in front of the adult, with the baby facing the adult with the baby's legs spread; and carrying the baby carrier in front of the adult, with the baby facing outwards.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1A:
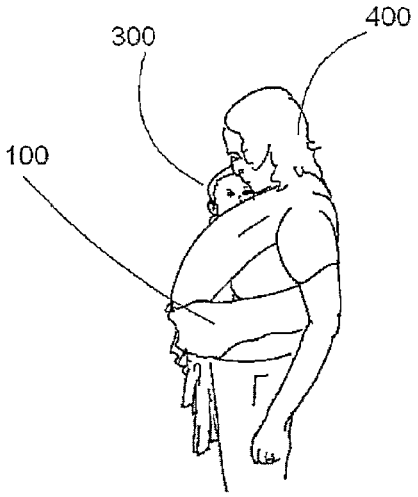
FIG. 1a PRIOR ART
FIGS. 1*a*-1*b*, of the prior art illustrates common carrying positions of babies by adults in front and on the back, by means of a wrap carrier.
Figure 1B:
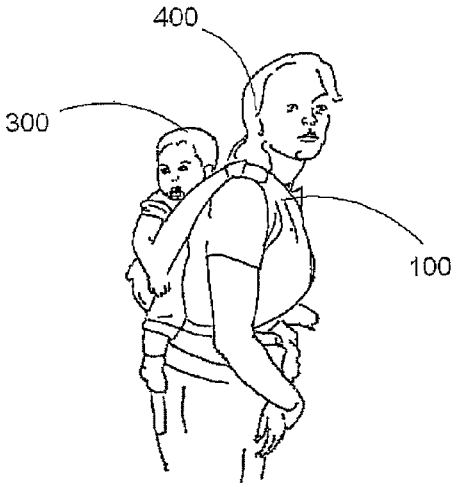
FIG. 1b PRIOR ART
Figure 2A:
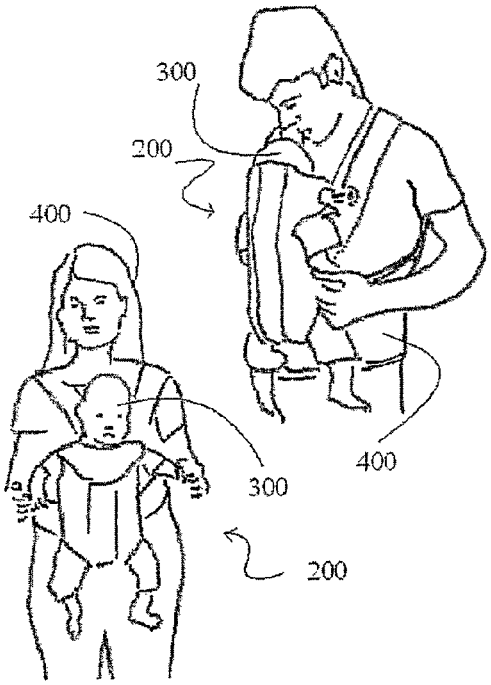
FIG. 2a PRIOR ART
FIGS. 2*a*-2*b* of the prior art illustrates carrying a baby in front upholstered carriers and in a backpack carrier.
Figure 2B:
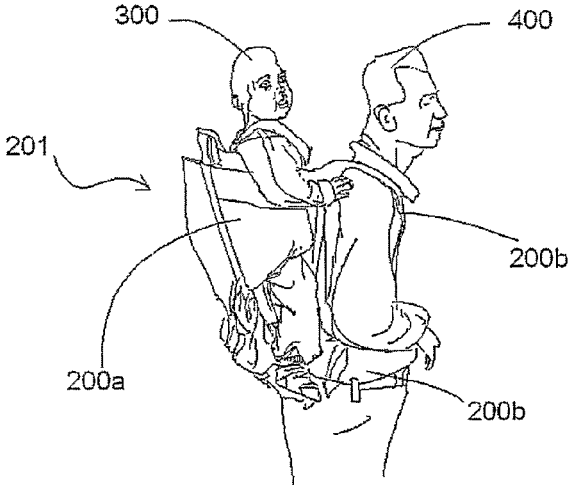
FIG. 2b PRIOR ART

The baby carrier according to the present invention is manufactured using a combination of shapes, whose specific combination creates a carrier which fits any baby and most adult size, from full term baby until a weight of approximately 18 kg, which is a reasonable weight limit for an adult to carry a baby in a carrier.

Innovative universal tubular shoulder pads, according to the present invention, are a solution applicable to baby carriers and any kind of backpacks.

The principles and operation methods of a baby carrier according to the present invention may be better understood with reference to the drawings and the accompanied description.

Before explaining at least one embodiment of the invention in detail, it is to be understood that the invention is not limited in its application to the details of construction and the arrangement of the components set forth in the following description or illustrated in the drawings.

Unless otherwise defined, all technical and scientific terms used herein have the same meaning as commonly understood by one of ordinary skill in the art to which this invention belongs. The materials, dimensions, methods, and examples provided herein are illustrative only and are not intended to be limiting.

Figure 3A:
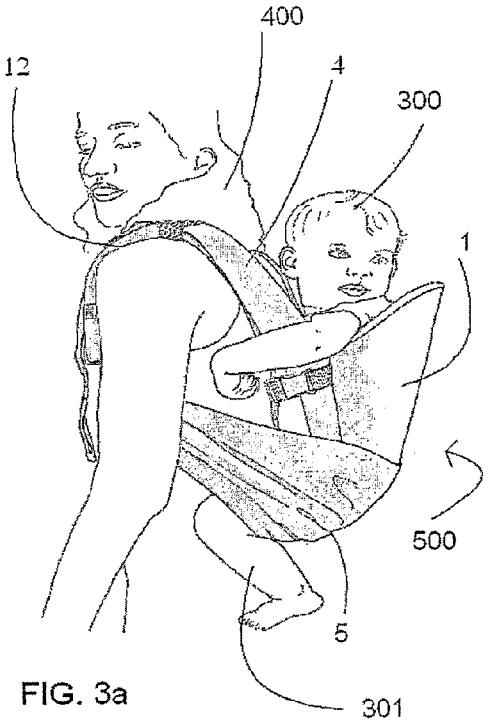
FIG. 3*a* is an illustration of a side view of a preferred embodiment of a baby carrier, in carrying position on an adult's back, with the baby's legs spread apart, around the adult's waist, according to the present invention.

The following list is a legend of the numbering of the application illustrations:

100 a prior art wrap carrier
200 a prior art front upholstered carrier
201 a prior art backpack carrier
200*a* a baby seat (in carrier 200)
200*b* a waist belt (in carrier 200)
300 baby
301 baby's legs
400 adult
500 baby carrier (according to the present invention)
1 back and neck support
2 baby crotch harness
3 baby security belt
4 side harnesses
5 baby leg holder
6 adjustment strap
7 adult chest security belt
8 lace loop
10 connection strap
11 adjustment buckle
12 tubular shoulder pad
13 tubular shoulder pad lower opening
14 baby leg holder padded margin
15 adult adjustment and locking buckle
16 adult locking latch
17 baby adjustment and locking buckle
18 baby latch
19 pacifier
20 vertical connecting stitch with back support
21 elastic filling of the back and neck support
22 casing of the back and neck support
23 exit opening of tubular shoulder pad for adjustment straps Referring now to the drawings, FIG. 3*a* is an illustration of a side view of a preferred embodiment of a baby carrier 500 in carrying position on the back of adult 400, carrying a baby 300 whose legs 301 are spread and whose knees are on the waist of adult 400, according to the present invention. The illustration shows primary elements of carrier 500, a back and neck support 1, a baby leg holder 5, which allows the piggy-back ride position, and spreads the weight of the baby around the adult's waist, a left tubular shoulder pad 12, and one side harness 4.

Carrier 500 has two tubular shoulder pads 12, one for each shoulder of adult 400.

Figure 3C:
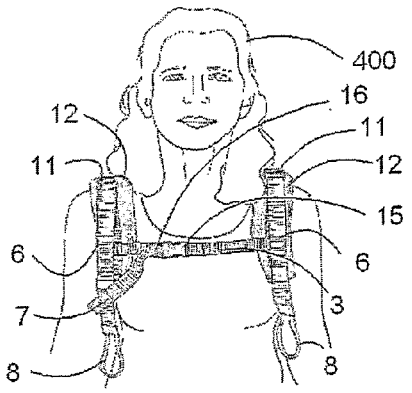
FIG. 3*c* is an illustration of a front view of a preferred embodiment of a baby carrier carried on the back, strapped onto an adult, according to the present invention.
Figure 3B:
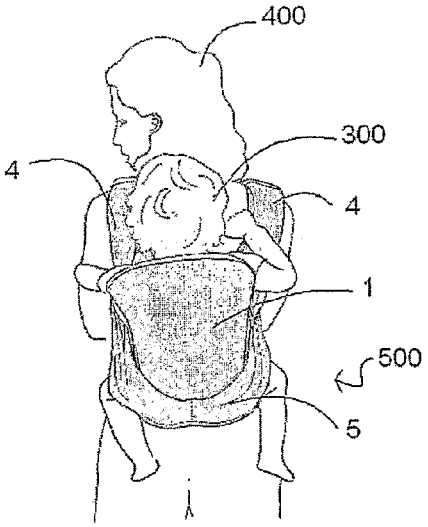
FIG. 3*b* is an illustration of a rear view of a preferred embodiment of a baby carrier, in carrying position on an adult's back, with the baby's legs spread apart around the adult's waist, according to the present invention.

FIG. 3*b* is an illustration of a rear view of a preferred embodiment of a baby carrier 500 in carrying position on the back of adult 400, carrying baby 300 whose legs are spread and whose knees are on the waist of adult 400, according to the present invention. This illustration also shows primary elements of baby carrier 500, the back and neck support 1, baby leg holder 5 which allows the piggy-back ride position, and spreads the weight of the baby around the adult's waist, and both the left and the right side harnesses 4.

FIG. 3*c* is an illustration of a front view of a preferred embodiment of a baby carrier strapped onto the back of an adult 400, according to the present invention. The illustration shows two lace loops 8, one at the end of each of two adjustment straps 6. Each of the adjustments straps 6 which goes through adjustment buckle 11 and serves to adjust the tubular shoulder pads 5, and to position the baby carrier 500 on the adult's back. Lace loops 8 can be used to hold various accessories, such as a pacifier or a toy to serve the carried baby, without falling. Lace loop 8 can be composed of two laces which can be tied together or connected by means of a suitable connector, in order to enable the connection to loops of accessories. The illustration also shows both parts of an adult chest security belt 7 each of which encompasses one of the tubular shoulder pads 12. Adult 400 secures the baby carrier 500 on his shoulders, by means of adult adjustment and locking buckle 15, and adult locking latch 16.

Figure 3D:
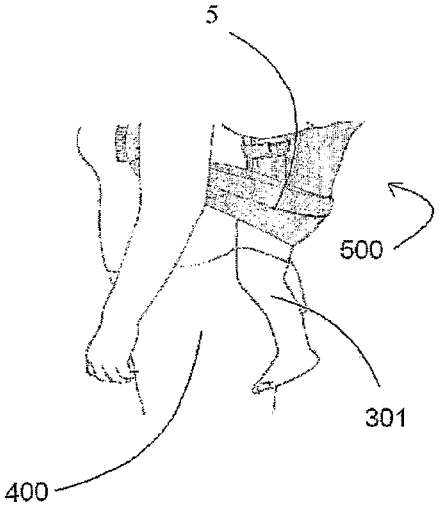
FIG. 3*d* is an illustration of a side view of a preferred embodiment of a baby carrier, in canning position on an adult's back, with the baby's legs hanging straight downwards, according to the present invention.

FIG. 3*d* is an illustration of a side view of a preferred embodiment of a baby carrier 500 in carrying position on the back of an adult, with the baby's legs 301 pointing down, according to the present invention. This figure shows the feature of the baby leg holder 5, when being neutralized. This neutralization is possible by folding the baby leg holder 5 backwards. The neutralization still keeps a wide support of the bottom which lowers the pressure on the baby's lower spine and pelvic bone.

Figure 4A:
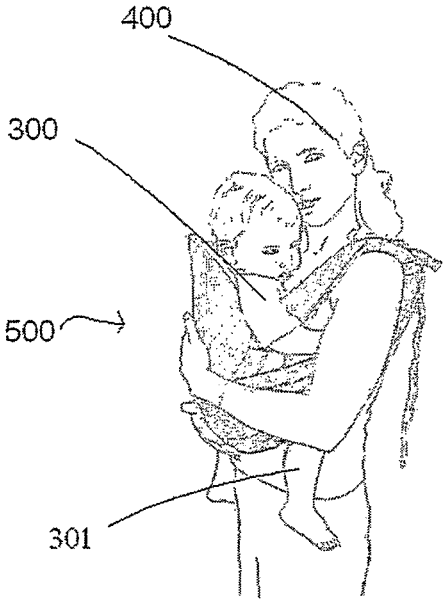
FIG. 4*a* is an illustration of a side view of a preferred embodiment of a baby carrier, in carrying position on an adult's front, with the baby's legs spread apart, according to the present invention.

FIG. 4*a* is an illustration of a side view of a preferred embodiment of a baby carrier 500 in carrying position on the adult 400 in front, with the baby's legs 301 are spread apart, according to the present invention, and the chest of the baby 300 facing the chest of the adult 400.

Figure 4C:
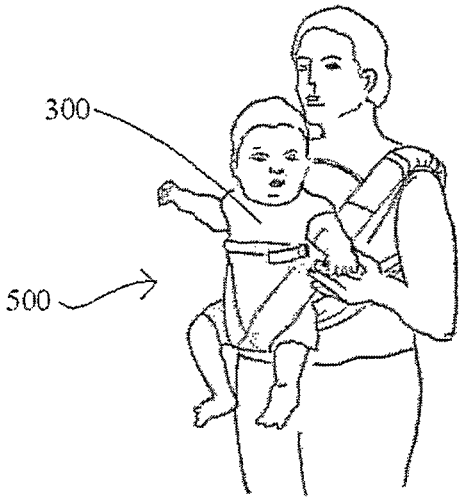
FIG. 4*c* is an illustration of a view of a preferred embodiment of a baby carrier, in carrying position on an adult's front, with the baby facing forward.
Figure 4B:
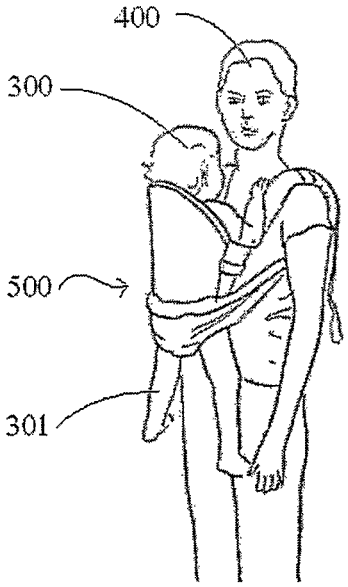
FIG. 4*b* is an illustration of a view of a preferred embodiment of a baby carrier, in carrying position on an adult's front, with the baby facing the adult and the baby's legs pointing downwards.

FIG. 4*b* is an illustration of a view of a preferred embodiment of a baby carrier 500, in carrying position on an adult's front, with the baby 300 facing the adult 400 and the baby's legs 301 pointing down.

FIG. 4*c* is an illustration of a view of a preferred embodiment of a baby carrier 500, in carrying position on an adult's front, with the baby 300 facing outward. This position demonstrates the ability to shift the carrier 500 from carrying position with the baby's chest facing the adult's chest to carrying position with the baby's back to the adult's chest, by inverting the carrier.

Figure 4D:
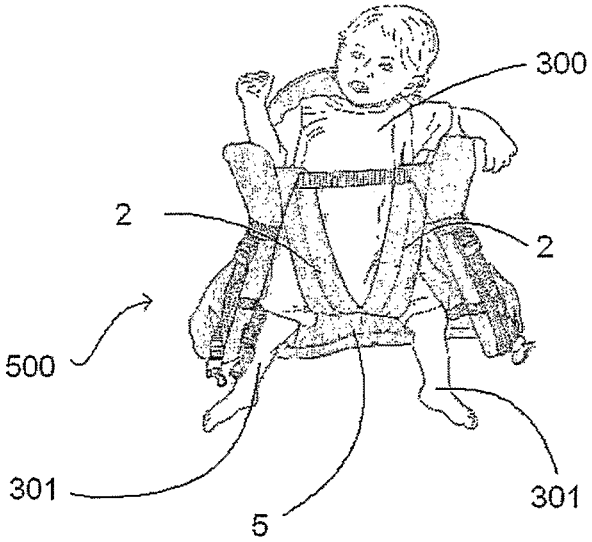
FIG. 4*d* is an illustration of a front view of a preferred embodiment of a baby strapped into a baby carrier, before being loaded on the adult, according to the present invention.

FIG. 4*d* is an illustration of a front view of a preferred embodiment of a baby 300 strapped and secured to a baby carrier 500, prior to it being loaded onto an adult, according to the present invention. The illustration shows the disposition of the baby crotch harnesses 2 between baby's legs 301 and the baby's legs in front of the baby leg holder 5.

Figure 5A:
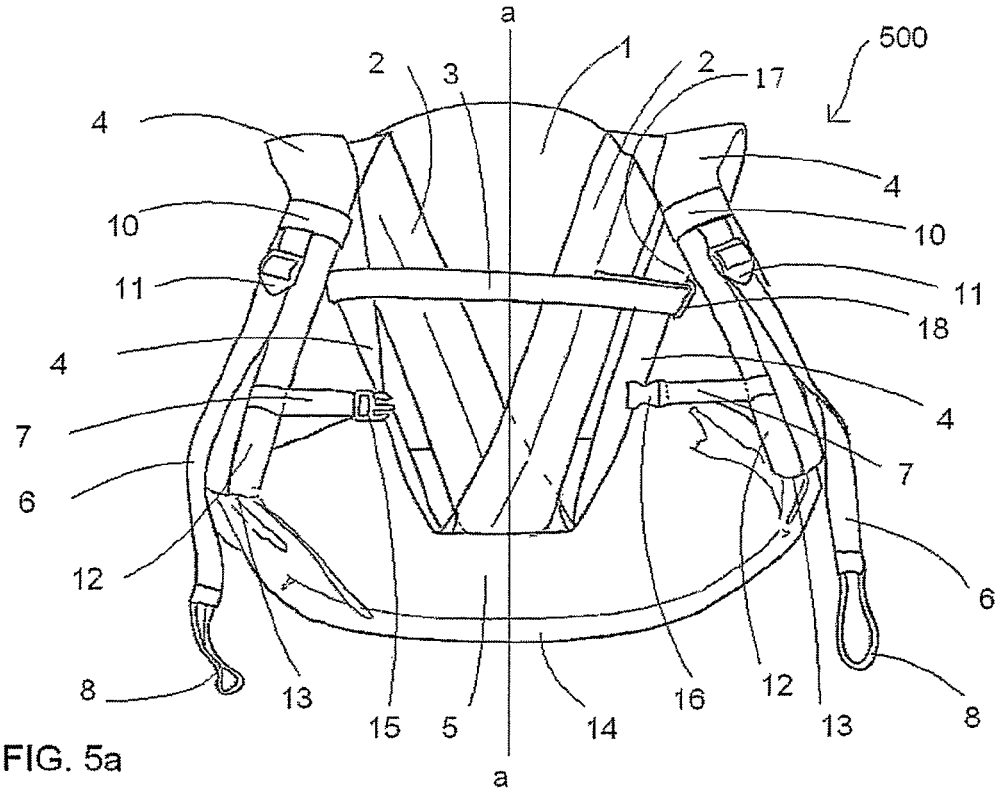
FIG. 5*a* is a schematic illustration of a front view of a preferred embodiment of a baby carrier, according to the present invention.

FIG. 5*a* is a schematic illustration of a front view of a preferred embodiment of a baby carrier 500, according to the present invention. This illustration shows the elements of baby carrier 500 and the mutual connections constructing the carrier. The whole baby carrier 500 has a symmetrical form with axis a-a, shown in the illustration, excluding the buckles. The back and neck support 1, which has a symmetrical form, granting structural integrity to withstand collapse, as will be described in detail with regard to FIGS. 6*e* and 6*f*, whose bottom part connects to baby crotch harnesses 2, which are two long straps creating an X form by being connected to the back and neck support 1, (as can be shown in FIG. 6*d*) functionally serving as a carrying harness, supporting the bottom and crotch of the carried baby from beneath. Baby crotch harnesses 2 can be made of a "Y" or "V" shape pattern that begins with one harness and then splits into two, can be made of one piece cut-out, can be made of fabric, can be composed of one or more layer, can be padded, and has, like all the other components of the carrier, a sufficient capacity for stretching loads as necessary for suitable safety qualities.

Each of the tubular shoulder pads 12 casings is connected to one of the baby crotch harnesses 2, actually one continues the other, and connects to the side harnesses 4. A connection strap 10 is one option of covering and strengthening a stitch that connects the tubular shoulder pad 12 to the side harness 4.

The solution of the tubular shoulder pads 12 as given in the present invention, gives a universal padding that suits the varying shoulder curves of different adults, gives a circumferential padding to soften contact beneath the adult's armpits, and serves as a track (tunnel) for both the adjustment straps 6 and the baby leg holder 5.

The adjustment straps 6 and the baby leg holder 5, entering the tubular shoulder pads' lower openings 13, and the adjustment straps 6 exiting higher up, from the tubular shoulder pads' exit opening 23. A more detailed explanation of the structure and function of the tubular shoulder pads 12 follows in the descriptions of FIGS. 6*a* and 6*b*. This detail is suitable for additional uses other than baby carriers.

Each of both connection straps 10 is assembled to the adjustment buckle 11 through which the adjustment strap 6 goes. Each adjustment strap 6 is connected on one side to the end of the baby leg holder 5, goes through the tubular shoulder pad lower opening 13, exits through exit opening 23, goes through the adjustment buckle 11, and has a lace loop 8. Pulling and loosening the adjustment straps 6 enables the adjustment of the position of baby carrier 500 on the back (high or low) and degree of proximity to the adult 400, while working as a system that enables easy carrying and is suitable for the varying sizes of most adults.

Lace loop 8, which can be made of one lace or two laces tied together or connected by means of a connector, serves to connect accessories such as a pacifier or toy, and enables giving them to the baby without fear of dropping them or losing them.

Baby leg holder 5, creates a hammock like structure which can be a wide strip of fabric, is the element that grants baby carrier 500 the ability to contain the baby's bottom and thighs and properly position the baby 300 on the adult 400, with legs around the adult's waist, without dangling, according to the present invention. The hammock-like three-dimensional structure is obtained by gathering the fabric's width to a narrower size to enable its entrance into the tubular shoulder pad 12.

The baby leg holders 5 can be connected to the tubular shoulder pads 12 by means of the adjustment straps and adjustment buckle.

The baby leg holder 5 is vertically connected in its middle to the symmetry axis of the back and neck support 1, and can have a padded section along its bottom referred to as the baby leg holder padded margin 14. Each sides of baby leg holder 5 connects as described above to one of the adjustment straps 6 and enters one of tubular shoulder pads 12 through tubular shoulder pads lower opening 13.

Baby leg holder 5 serves to carry the load by encompassing the baby's bottom and thighs when they are spread in a manner that eliminates the undesired moment of dangling legs which usually occurs when carrying a big baby or toddler in common carriers. Some of the weight from the adult's shoulders is shifted to his waist, as in the weight distribution when carrying a baby in "piggy-back ride" position on the back and in front as well. The leg spread decreases the load on the baby's spine and pelvic floor.

Carrying a baby in baby carrier 500 with his legs pointing down is possible when baby leg holder 5 is folded outwards and upwards by its length from its bottom part, and becomes a narrower strip with regard to its full width in open mode. This method is performed on small infants who are not yet ready to spread their legs, yet gives a wide support to prevent pressure as described previously. FIG. 3*d* shows the baby leg holder 5 being folded upwards to form a strip that is narrower in width by approximately half of the width of the baby leg holder 5 in the open mode shown in FIG. 3*a*. Note that the width refers to the dimension that runs upwards toward the baby's head or downward from the baby's head.

Carrier 500 has two arrangements of lateral safety straps, the first for securing the baby, a baby security belt 3, which includes two lateral straps, each of which is connected at one end to one of the side harnesses 4 and the other one of which is assembled to a baby adjustment and locking buckle 17, while the second strap is assembled to a baby latch 18, enabling their latching (and unlatching) to each other at a suitable length for securing the baby.

The second arrangement, which is for securing the baby carrier 500 on the adult, includes the two adult chest security belts 7. The adult chest security belts 7 encompasses the tubular shoulder pads 12 and are adjustable both vertically and horizontally, vertically up and down, to enable the comfortable position on the chest or back of an adult; and horizontally adjusting the length, locking and unlocking. The adult chest security belts 7 is by means of the adult adjustment and locking buckle 15 and the adult latch 16, assembled to the adult chest security belts 7.

To complete the three-dimensional and the weight load carrying structure of carrier 500, the two side harnesses 4, are used. Each of the side harnesses 4 connects one of the sides of the back and neck support 1 to one of the tubular shoulder pads 12.

The side harnesses 4 have the form of an elongated triangle. The connection of side harnesses 4 to back and neck support 1 is done along part of one of the triangle's longer sides. Furthermore, each side harness 4 is connected to a tubular shoulder pad 12 in the area of the vertex opposite to the short side of the triangle.

Figure 5B:
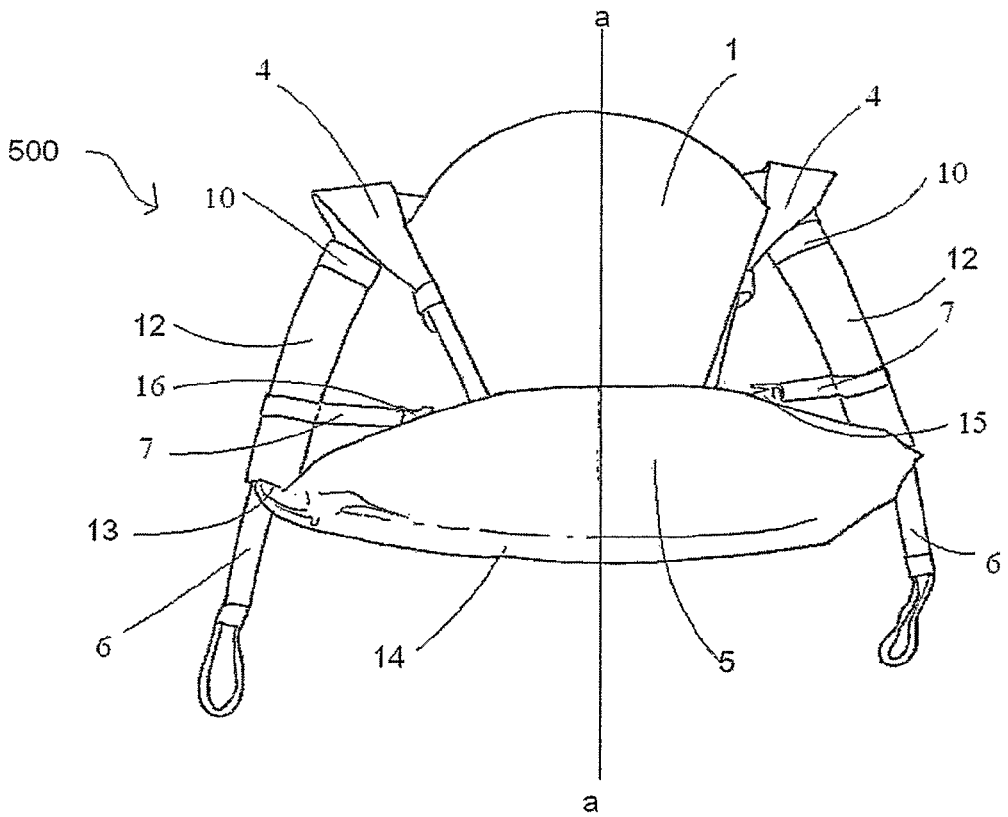
FIG. 5*b* is a schematic illustration of a rear view of a preferred embodiment of a baby carrier, according to the present invention.

FIG. 5*b* is a schematic illustration of a rear view of a preferred embodiment of a baby carrier 500, according to the present invention. This illustration clearly shows the back of the back and neck support 1, the two tubular shoulder pads 12, one of the tubular shoulder pad lower openings 13, the baby leg holder 5, the baby leg holder padded margin 14 and the two side harnesses 4.

Figure 6A:
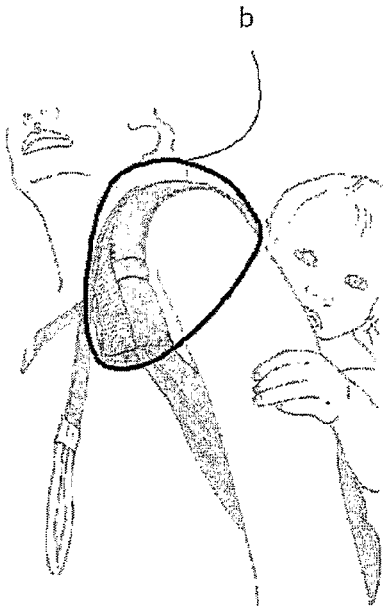
FIG. 6*a* is a schematic illustration of a side view of tubular shoulder pads, which is a detail of a preferred embodiment of a baby carrier, according to the present invention.

FIG. 6*a* is a schematic illustration of a side view specifying an area of a detail of the left tubular shoulder pad 12, which is a detail of a preferred embodiment of a baby carrier, according to the present invention.

Figure 6C:
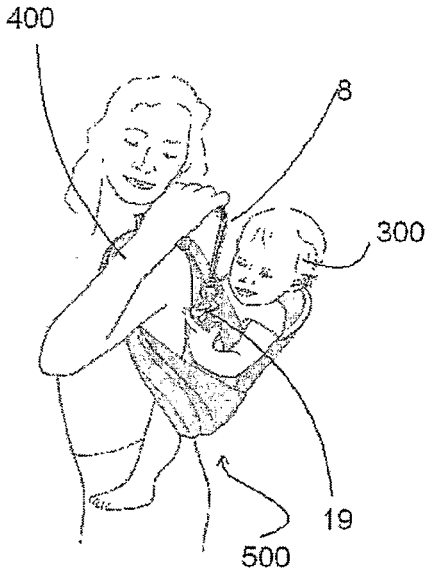
FIG. 6*c* is an illustration of a side view of an adult giving a baby carried in a baby carrier a pacifier, connected to the loop at an end of an adjustment strap of the baby carrier according to a preferred embodiment of the present invention.
Figure 6B:
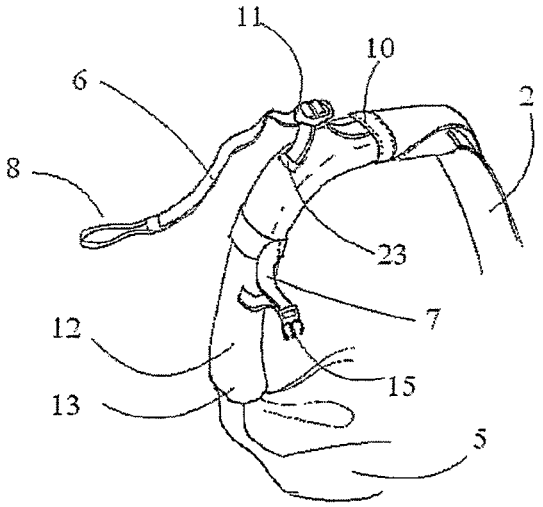
FIG. 6*b* is an illustration further elaborating on the detail of FIG. 6*a*.

FIG. 6*b* is a further elaboration of the detail of FIG. 6*a* that shows the arrangement of the tubular shoulder pad 12 and the adjustment strap 6, which is a detail of a preferred embodiment of the baby carrier 500, according to the present invention.

Tubular shoulder pads 12 serve as a universal padding that suits the different shoulder curves of adults, gives a circumferential padding to soften contact beneath the adult's armpits, and serves as a track (tunnel) for the adjustment straps 6.

The innovative tubular shoulder pads 12 are a solution applicable to baby carriers as well as any kind of backpack.

Tubular shoulder pads 12 have walls with an exit opening 23.

This illustration reveals the detail of the exit opening 23 of the tubular shoulder pad 12 for the adjustment strap 6 at the upper part of each of both tubular shoulder pads 12, and the adjustment strap 6 that exits through the opening.

The tubular shoulder pads 12 are made of a tube, with a fabric casing that is connected and closed onto the baby crotch harnesses 2 on one side and is left open on the other side, as a tubular shoulder pad lower opening 13, to let the adjustment strap 6 and the baby leg holder 5 go in and out. The tubular shoulder pad 12 can be made of a pre-formed tube, can be made of a surface formed as a tube, and can be closed or partially closed to serve as a tunnel.

The exit opening 23 is cut once into the casing, and cut once into the corresponding location on the tube.

When the adjustment straps 6 are pulled, the carrier's position on the adult's back or front is changed, as well as the proximity of the baby to the adult. When pulling the adjustment strap 6, the baby leg holder 5, which is connected to adjustment strap 6, can optionally enter the tubular shoulder pad's lower opening 13 but not exit through exit opening 23.

FIG. 6*c* is an illustration of a side view of adult 400 giving a baby 300, with his legs spread carried in baby carrier 500, a pacifier 19 connected to lace loop 8.

Figure 6D:
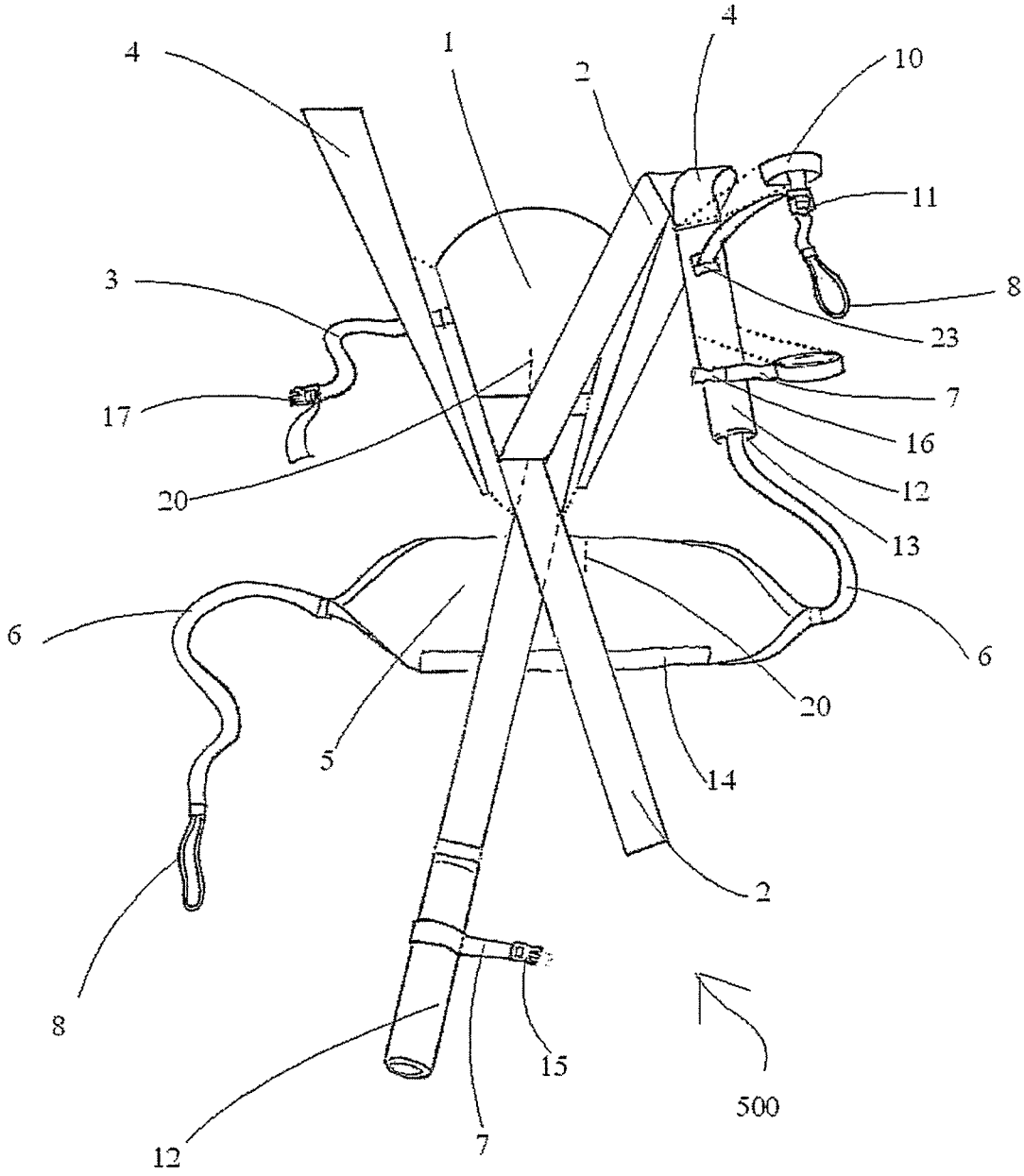
FIG. 6*d* is all illustration of an exploded view of a baby carrier according to a preferred embodiment of the present invention.

FIG. 6*d* is an illustration of an exploded view of a baby carrier 500 according to a preferred embodiment of the present invention.

The baby carrier 500 has a symmetry axis a-a as described in FIGS. 5*a* and 5*b*, and what is described here applies to both sides of the baby carrier 500.

The illustration shows asymmetrically the different steps of the assembly of the carrier 500.

Each one of the baby crotch harnesses 2 (two straps that are crossed) is connected to the lower part of the back and neck support 1 on one of its ends, and to the tubular shoulder pad 12 on the other end. Each side harness 4 (on both sides of baby carrier 500) is connected on one end of the baby crotch harness 2, continues on the side of the back and neck support 1, and then is connected to the tubular shoulder pad 12.

Connecting strap 10 is an extra strap to strengthen the stitching of side harness 4 to the tubular shoulder pad 12.

The adjustment straps 6 are connected to the leg holder 5 on both ends, and the leg holder 5 is connected to the back and neck support 1 by a vertical connecting stitch 20 in the lower central part of the back and neck support 1. A lace loop 8 is connected to each end of adjustment straps 6. The adjustment strap 6 goes through the lower opening 13 of the tubular shoulder pad 12 (each strap through each tube), then comes out through the exit opening 23, and through the adjustment buckle 11.

The illustration also shows the adult adjustment and locking buckle 15 and adult locking latch 16, adult chest security belt 7 encompassing the tubular shoulder pad 12, and the baby adjustment and locking buckle 17 of baby security belt 3 that is connected to the side harnesses 4.

Figure 6E:
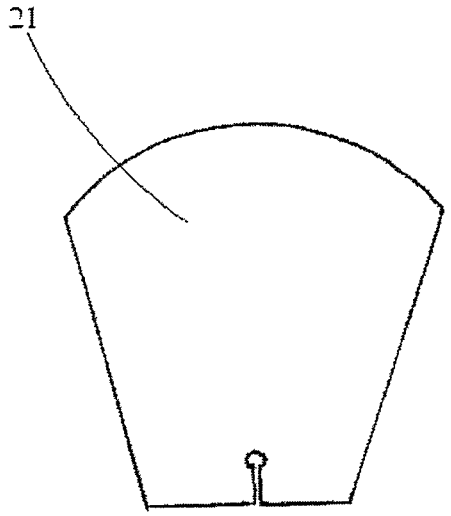
FIG. 6*e* is a schematic illustration of the back and neck support filling of a preferred embodiment of a baby carrier, according to the present invention.

FIG. 6*e* is a schematic illustration of an elastic filling of the back and neck support 1, of a preferred embodiment of a baby carrier, according to the present invention.

Figure 6G:
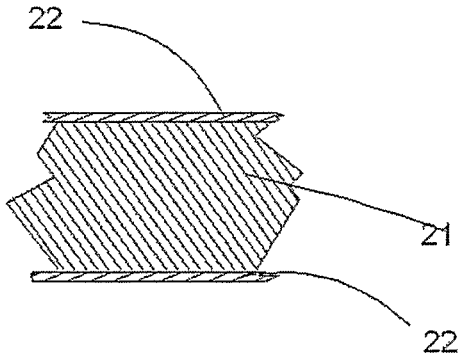
FIG. 6*g* is a schematic illustration of a section of a back and neck support of a preferred embodiment of a baby carrier, according to the present invention.
Figure 6F:
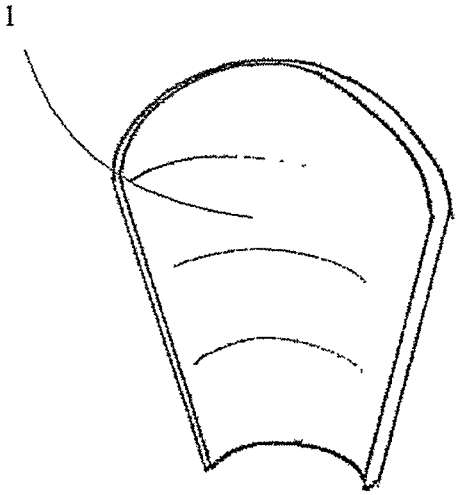
FIG. 6*f* is a schematic illustration of the back and neck support of a preferred embodiment of a baby carrier, showing its flexibility, according to the present invention.

FIG. 6*f* is a schematic illustration of a back and neck support 1, of a preferred embodiment of a baby carrier, showing its flexibility, according to the present invention. It is made of a flexible flat surface, which gains its structural integrity from the natural concaving created when the baby is placed in the baby carrier. When the surface is concaved, it does not fold outwards, thus supporting the baby's head and neck. The arch at the top part of the back and neck support 1 is designated to support the baby's neck and still enable him to stick his hands out of the sides. The top arch can be segmented and can have a different curve to support the back and neck and yet enable the baby to stick his hands out of the sides FIG. 6*g* is a schematic illustrations of a section of a back and neck support of a preferred embodiment of a baby carrier, according to the present invention. The illustration shows the section of a possible preferred structure according to which the back and neck support include a relatively thick elastic filling material 21, or materials which can be chosen from a group of elastic materials, such as polyurethane for example, which have suitable elastic qualities to grant the carrier according to the present invention qualities of strength, flexibility, ventilation, and padding. The elastic filling material 21 is covered by a relatively thin casing 22 which could also be made of a suitable fabric. The inner casing will usually be made of fabric, seeing as it comes in contact with the baby.

The terms "relatively thick" and "relatively thin" refer to comparison between the components of the back and neck support.

As used herein the specification and hi the claims section that follows, the term "elasticity" and the like refer to the property and ability of materials to substantially recover their original size and shape when load is removed after deformation.

Figure 7A:
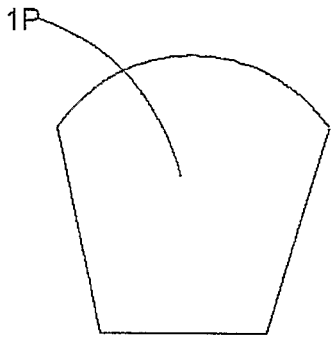
FIGS. 7*a*-7*e* are schematic illustrations of patterns spread out after cutting and prior to fabrication as parts of a baby carrier according to a preferred embodiment of the present invention.

FIG. 7*a* is a schematic illustration of pattern 1P. Two such patterns are connected together at their edges, designated to serve as the casing (or cover) of the back and neck support. This pattern has a trapezoid shape whose wide base is at the top and has the addition of a segment of an arch at the top. Filling material, which can be made of an elastic surface, of similar pattern is inserted into the casing (or cover).

Figure 7B:
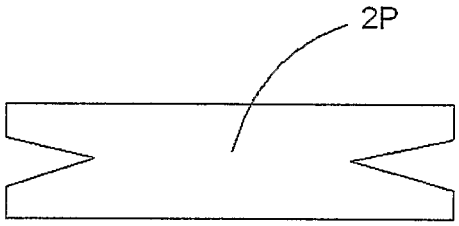

FIG. 7*b* is a schematic illustration of pattern 2P which can be made of fabric or Polytex and is designated to serve as one layer of the baby leg holder. Its form is of an elongated rectangle, with each of both of its short-sided ends missing a segment in the form of an equilateral triangle, whose vertex is approximately on the rectangle's longitudinal symmetry axis. The sides of the missing triangular segments are sewn to one another thus forming a three-dimensional structure which is designated to support the baby's bottom and thighs.

Figure 7C:
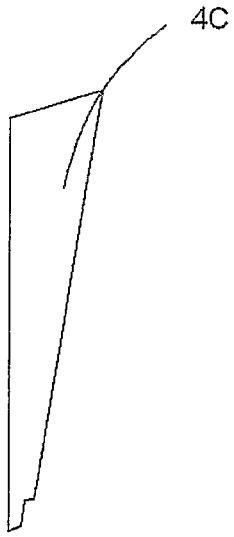

FIG. 7*c* is a schematic illustration of pattern 4*c* which can be made of fabric and is designated to be the casing of a side harness. Its form is of an elongated triangle which has one vertex which is clipped in gradated form.

Figure 7D:
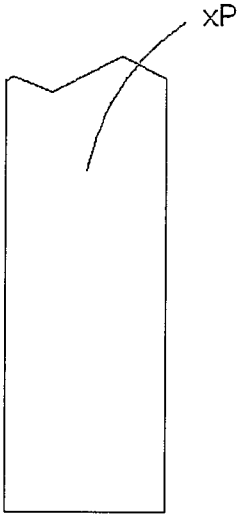

FIG. 7*d* is schematic illustrations of pattern xP which can be made of fabric. Two pieces of this pattern are disposed in an X form to serve as casing for the baby crotch harnesses.

Its form is of an elongated rectangle one of whose edges has a short end clipped in zigzag form.

Figure 7E:
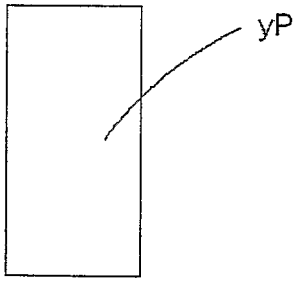

FIG. 7*e* is a schematic illustration of pattern yP which can be made of fabric and is designated to serve as the casing of the shoulder pads' tubular filling. Its form is rectangular.

FIGS. 8*a*-8*h* are schematic illustrations of steps of a method using a baby carrier 500 according to a preferred embodiment of the present invention, for carrying a baby on an adult's chest, starting with the baby lying down.

Figure 8A:
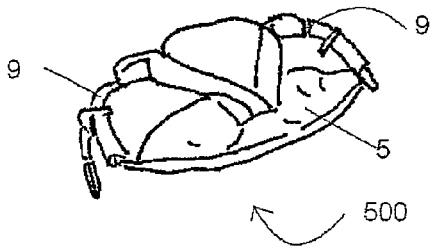
FIGS. 8*a*-8*h* are schematic illustrations of steps of a method of using a baby carrier according to a preferred embodiment of the present invention, for carrying in front, starting with the baby lying down.

FIG. 8*a* shows the first step, in which carrier 500 is spread open, with the inside facing outwards, and the baby leg holder 5 and the tubular shoulder pads 12, spread to the sides.

Figure 8D:
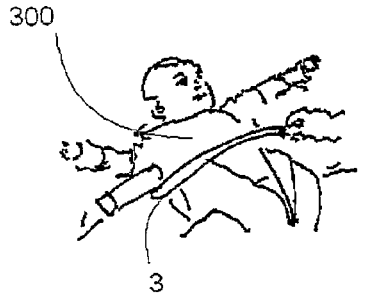
Figure 8B:
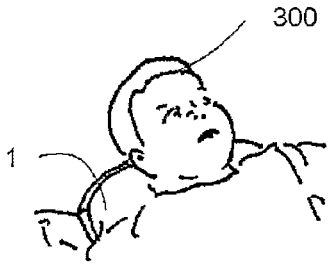

FIG. 8*b* shows a step in which baby 300 is centered with his back towards the back and neck support 1, to allow head support for small babies, positioning the back of the baby's neck and the lower half of his head on the back and neck support 1.

Figure 8E:
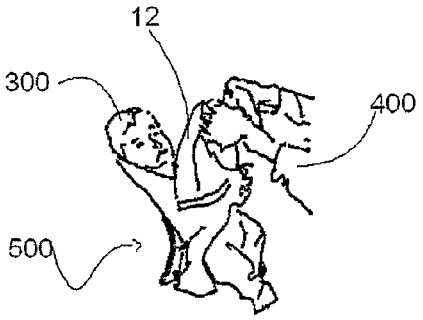
Figure 8C:
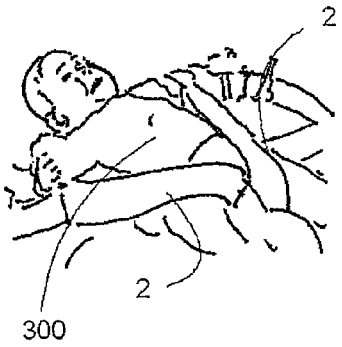

FIG. 8*c* shows a step in which baby crotch harnesses 2 are passed between the legs of the baby 300.

FIG. 8*d* shows a step in which the baby security belt 3 is closed above the baby crotch harnesses 2 and tightened until baby 300 is comfortably secured.

FIG. 8*e* shows an option in which, instead of bending towards baby 300, it is possible to lift the loaded baby carrier 500 by its shoulder pad 12, thus while lifting the loaded carrier 500, baby 300 is well-balanced.

Figure 8F:
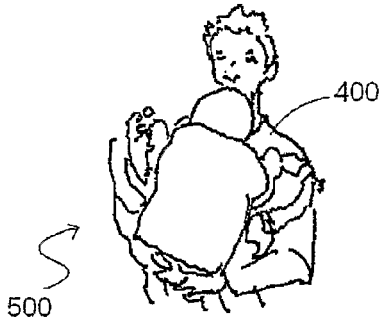

FIG. 8*f* shows a step in which the loaded baby carrier 500, is lifted to the adult's chest.

Figure 8G:
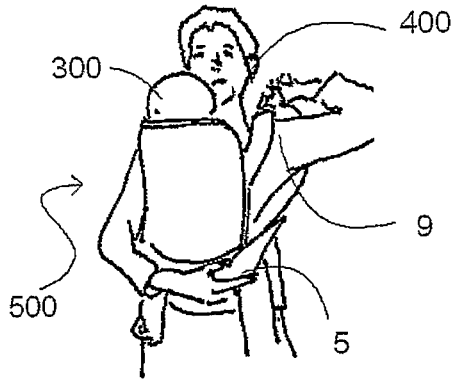

FIG. 8*g* shows a step is which adult 400 positions the tubular shoulder pads 12, one after the other while supporting the loaded carrier 500 from the bottom by the baby leg holder 5.

Figure 8H:
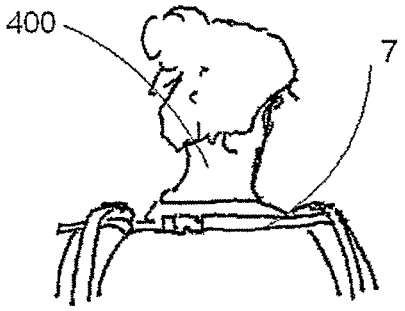

FIG. 8*h* shows a step in which adult 400 closes the adult chest security belt 7 disposed on the upper part of his back.

FIGS. 9*a*-9*d* are schematic illustrations of steps of a method using a baby carrier 500 according to a preferred embodiment of the present invention, for carrying a baby on an adult's back, starting with the baby lying down.

Figure 9A:
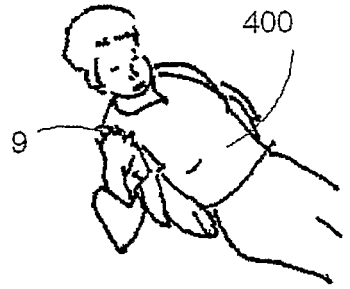
FIGS. 9*a*-9*d* are schematic illustrations of steps of a method using a baby carrier according to a preferred embodiment of the present invention, for carrying on an adult's back, starting with the baby lying down.

FIG. 9*a* shows a step to enable lifting the baby carrier onto the back of an adult from lying position, in which the baby is already secured in the baby carrier in the same method like shown in illustrations 8*a*-8*d*. Adult 400 leans backwards (with his back to baby 300) and grasps the tubular shoulder pads 12, one after the other.

Figure 9B:
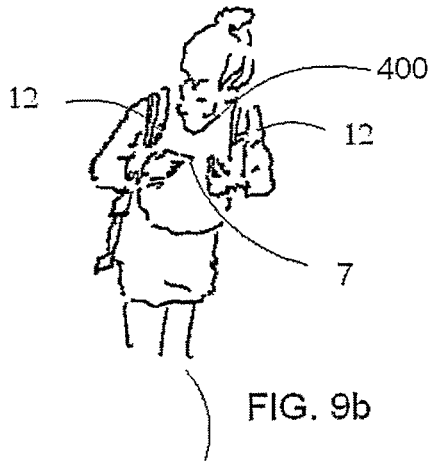

FIG. 9*b* shows a step in which adult 400 stands up and locates the adult chest security belt 7, adjusts and locks it. If baby carrier 500 is being used for the first time or after having been used by someone else, adult 400 adjusts the adjustment straps 6 to suit his size. Adult 400 shifts the baby's weight by tilting forwards and pulling the straps evenly.

Figure 9C:
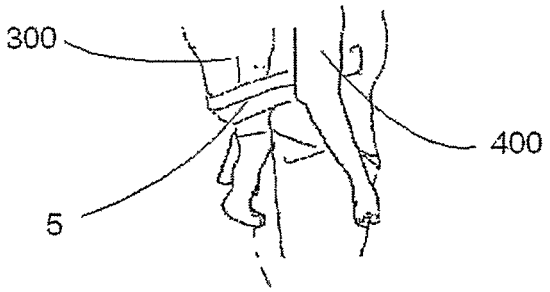

FIG. 9*c* shows a step in which, to bring the baby's legs to be pointing downwards, adult 400 ensures that the baby leg holder 5 is folded outwards.

Figure 9D:
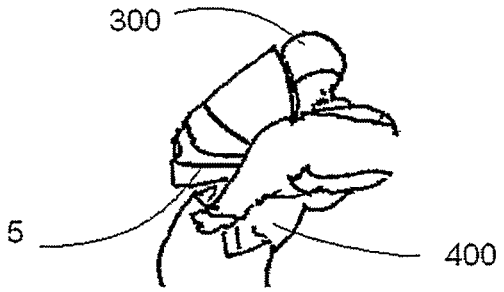

FIG. 9*d* shows a step which is suitable for a bigger baby 300, when it is better to distribute the weight on the adult's back and shoulders by spreading the baby's legs. Adult 400 shifts the baby's weight by tilting forwards and fixing the baby leg holder 5 under the baby's backside and thighs.

Figure 10A:
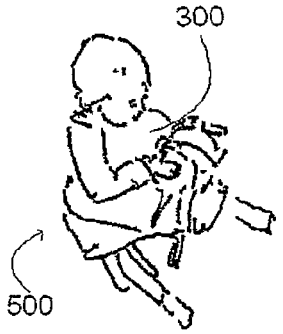
FIGS. 10*a*-10*c* are schematic illustrations of steps of a method using a baby carrier according to a preferred embodiment of the present invention, for carrying on an adult's back, starting with the baby sitting.
Figure 10B:
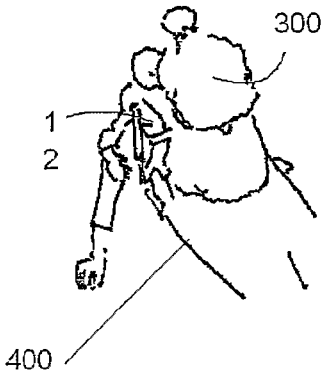
Figure 10C:
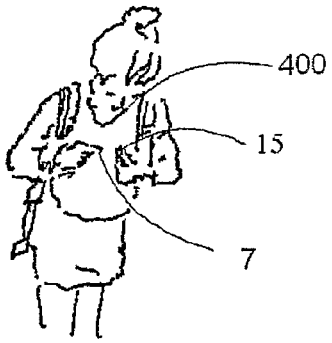

FIGS. 10*a*-10*c* are schematic illustrations of steps of a method using a baby carrier 500 according to a preferred embodiment of the present invention, for carrying on an adult's back, starting with the baby seated. The first steps include preparation of the baby for carrying by loading and securing him in the carrier as shown in FIGS. 8*a*-8*d*.

FIG. 10*a* shows a situation in which the baby 300 can sit, secured in baby carrier 500.

FIG. 10*b* shows a step in which while the adult 400 is sitting, with the baby 300 facing his back, adult 400 extends his arms to the tubular shoulder pad 12 and grasps them firmly, to place them on his shoulders, one arm after the other.

FIG. 10*c* shows a step in which adult 400 stands up, locates and adjusts the adult chest security belt 7, and locks the adult adjustment and locking buckle 15 and latch 16. In order to adjust the leg holder 5 the adult 400 shifts the baby's weight, tilts forward, and arranges the baby leg holder 5, (shown in FIG. 9*d*), under the baby's backside and thighs for optimal support. If the baby carrier 500 is being used for the first time or after having been used by someone else, adult 400 adjusts the tubular shoulder pads 12, to suit his size until he feels comfortable and ensures that the tubular shoulder pads 12 are symmetrical.

For a better distribution of the weight on the back and shoulders of the adult 400 and reducing pressure on the baby's spine, it is advisable to spread the baby's legs by shifting the baby's weight and tilting forwards and tightening the baby leg holder 5 under the baby's backside and thighs.

FIGS. 11*a*-11*e* are schematic illustrations of steps of a method using the baby carrier 500 according to a preferred embodiment of the present invention, for carrying on an adult's back, starting with the baby standing.

Figure 11A:
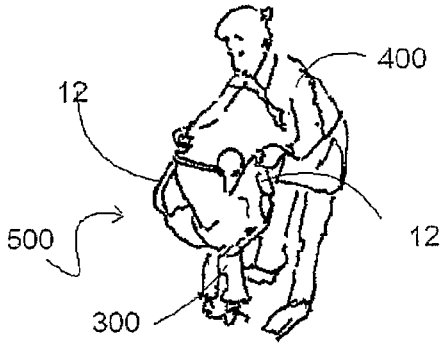
FIGS. 11*a*-11*e* are schematic illustrations of steps of a method using a baby carrier according to a preferred embodiment of the present invention, for carrying on an adult's back, starting with the baby standing.

FIG. 11*a* shows a step in which baby 300 is standing and adult 400 holds the baby carrier 500 by its tubular shoulder pads 12.

Figure 11B:
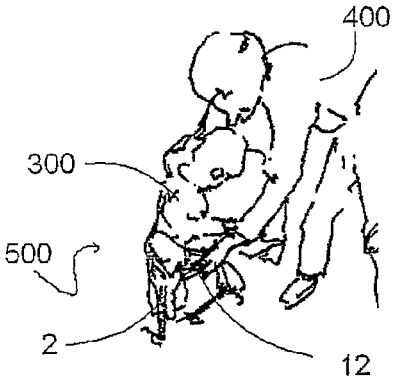

FIG. 11*b* shows a step in which baby 300 is standing and adult 400 lowers the baby carrier 500 to floor level, and places the baby's legs in baby carrier 500 (similar to dressing the baby with underpants) so that the baby crotch harnesses 2 are between the baby's legs, the leg holder 5 is behind the baby and the tubular shoulder pads 12 are held by baby 300.

Figure 11C:
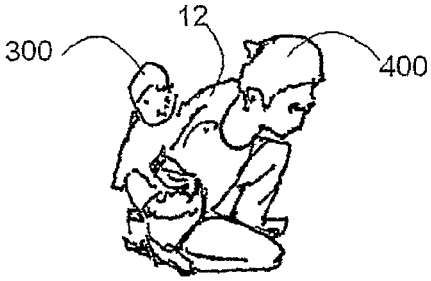

FIG. 11*c* shows a step in which after latching the baby security belt, while the baby's hands are kept free, adult 400 assumes a lower position (or places baby 300 on a higher surface, such as a chair) with his back towards baby 300, and adult 400 passes his arms through the tubular shoulder pads 12.

Figure 11D:
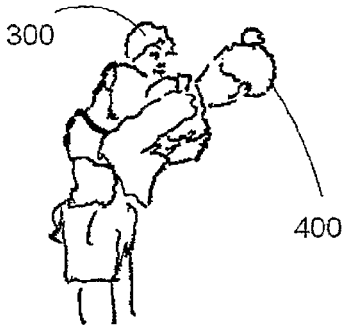

FIG. 11*d* shows a step in which adult 400 stands up with baby carrier 500 on his shoulders and back.

Figure 11E:
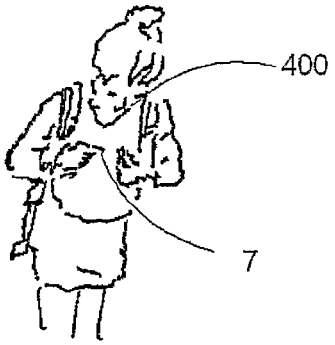

FIG. 11*e* shows a step in which adult 400 adjusts and locks the adult chest security belt 7, and then in order to adjust the leg holder 5 the adult 400 shifts the baby's weight, tilts forward, and arranges the baby leg holder 5, (shown in illustration 9*d*), under the baby's backside and thighs for optimal support.

Figure 12A:
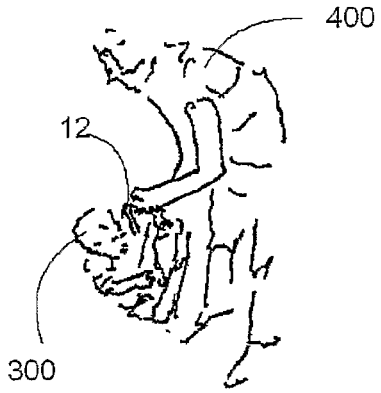
FIGS. 12*a*-12*c* are schematic illustrations of steps of a method using a baby carrier according to a preferred embodiment of the present invention, for carrying on an adult's back, by lifting the baby in a swinging motion.
Figure 12B:
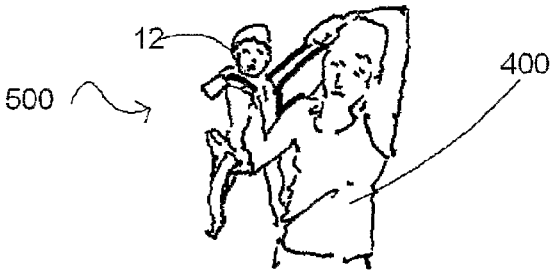
Figure 12C:
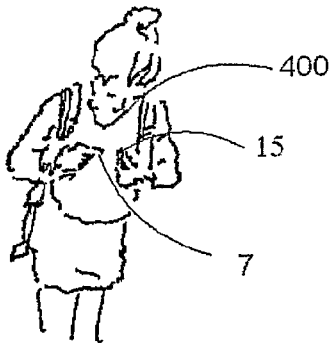

FIGS. 12*a*-12*c* are schematic illustrations of steps of a method using a baby carrier 500 according to a preferred embodiment of the present invention, for carrying on the back of adult 400, by lifting the baby 300 in swinging motion. This method is recommended if adult 400 is experienced or feels confident. It is better to use this method with babies above the age of 6 months to prevent the baby's hands from being caught. There are several methods of swinging the baby carrier 500 onto the back.

FIG. 12*a* shows a step in which, with baby 300 already secured in the carrier, lying, sitting or standing in the carrier, adult 400 stands face to face with the baby 300, holding the tubular shoulder pads 12 with crossed arms so the right arm is holding the left tubular shoulder pad 12 and the left arm is holding the right tubular shoulder pad 12.

FIG. 12*b* shows a step in which adult 400 swings the baby carrier 500 as though it were a backpack, from the front to the back through one of his shoulders, simultaneously passing one arm after the other through the respective tubular shoulder pads 12.

FIG. 12*c* shows a step in which the baby is located on his back and then in order to fix the leg holder 5 the adult 400 shifts the baby's weight, tilts forward, and arranges the baby leg holder 5, (shown in FIG. 9*d*), under the baby's backside and thighs for optimal support.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A baby carrier, comprising:

a back and neck support facilitating back, neck and head support for said baby, the back and neck supporting defining a baby-spine direction and a baby side-to-side direction perpendicular thereto; and a baby leg holder comprising a hammock that is permanently formed between first and second ends thereof, a central axis and a length direction of the hammock being along the baby side-to-side direction and perpendicular to the baby-spine direction, a width-direction of the hammock being along the baby-spine direction, the first end of hammock to be positioned on one side of a baby and the second end thereof to be positioned on a second side of the baby, the hammock being disposed substantially at the lower end of said back and neck support, the hammock being width-adjustable to adapt to a desired position of the legs of the baby and to cover a variety of sizes and amounts of said baby's bottom and legs, the desired position including a first leg position in which the legs point downward and a second leg position in which the legs are spread so that the baby's knees are higher than the baby's bottom, the hammock further being length-adjustable when the baby is carried in and supported by the carrier;

the hammock having a wider central portion and narrower first and second ends, each of the first and second ends connected to respective first and second shoulder pads via respective straps that respectively extend from the first and second ends of the hammock, a closed loop of integrally connected material including the baby leg holder, back and neck support, first shoulder pad and second shoulder pad, the closed loop being structured to enable the caretaker to load a baby into the carrier and hang the carrier with the baby by the shoulder pads before wearing the carrier and to then wear the carrier without assistance from another person by successively inserting the caretaker's arms through the shoulder pads so as, at the option of the caretaker, to carry the baby on a back of the caretaker, or at the option of the caretaker, to carry the baby in front of the caretaker.

2. A baby carrier as in claim 1, further comprising:

a baby crotch harness having an end disposed at said back and neck support wherein said baby crotch harness has a split form before and after loading the baby carrier with the baby and before and after hanging the baby carrier by the shoulder pads, wherein the closed loop of material including the baby leg holder, back and neck support, first shoulder pad, second shoulder pad and baby crotch harness, the closed loop structured to enable the caretaker to load the baby into the carrier and securely hold the carrier with the baby before wearing the carrier and to then wear the carrier so as, at the option of the caretaker, to carry the baby in a secure and comfortable way on a back of the caretaker, or at the option of the caretaker, to carry the baby in a secure and comfortable way in front of the caretaker.

3. The baby carrier of claim 1 having a frameless structure.

4. The baby carrier of claim 1, wherein said back and neck support is made of a flexible flat surface, has a flat form when no bending force is applied on said back and neck support, and when curved, such that a horizontal cross-section of the back and neck support has a curved form, achieves increased structural rigidity, which operatively carries the bending loads applied on said back and neck support, thereby facilitating back and neck support for said baby.

5. The baby carrier of claim 1, wherein the first and second shoulder pads are tubular and the first end of the baby leg enters the first tubular shoulder pad and the second end of the strip of material enters the second tubular shoulder pad, wherein the baby leg holder is movable relative to said first and second tubular shoulder pads.

6. The baby carrier of claim 5, wherein each of said first tubular shoulder pad and said second tubular shoulder pad includes a lower end, an upper end and a wall disposed between said lower end and said upper end, wherein said wall of each of said first and second tubular shoulder pads includes a caretaker side wall and an external side wall, wherein a lower opening is formed at said lower end of each of said tubular shoulder pads, and wherein an exit opening is formed in said external wall, proximal to said upper end, of each of said tubular shoulder pads, wherein a first adjustment strap passes through said lower opening in said lower end of said first tubular shoulder pad and exits through said exit opening in said external side wall of said first tubular shoulder pad and then passes through a first adjustment buckle, and wherein a second adjustment strap passes through said lower opening in said lower end of said second tubular shoulder pad and exits through said exit opening in said external side wall of said second tubular shoulder pad and then passes through a second adjustment buckle, wherein the first and second adjustment straps are each movable relative to the respective first and second tubular shoulder pads, and wherein the first and second adjustment buckles are fixed relative to the respective first and second tubular shoulder pads.

7. The baby carrier of claim 1, wherein the first and second shoulder pads are tubular and further comprising a first adjustment buckle disposed at, and fixed relative to, the first tubular shoulder pad and a second adjustment buckle disposed at, and fixed relative to, the second tubular shoulder pad, wherein the first end of the hammock enters the first tubular shoulder pad and the second end of the hammock enters the second tubular shoulder pad.

8. A method of carrying a baby by an adult, comprising the steps of:

(a) providing a baby carrier as in claim 2;

(b) securing said baby inside said baby carrier, including:

(i) spreading said baby carrier open;

(ii) positioning the back of said baby onto said back and neck support;

(iii) passing the baby crotch harness between the legs of said baby; and (iv) securely closing a baby adjustment and locking strap assembly that includes a security belt, the security belt disposed at said back and neck support, and tightening said security belt until the baby is comfortably secured, and (c) lifting said baby carrier with said secured baby.

9. The method of claim 8, further comprising the step of:

(d) loading and mounting said baby carrier with a baby onto a selected carrying position; and (e) carrying said baby carrier by said adult.

10. The method of claim 9, wherein said selected carrying position is selected from the group consisting of: said adult's chest, said adult's back; wherein the face of said baby is in position selected from a group consisting of: facing said adult, facing away from said adult.

11. The baby carrier of claim 6, wherein said upper end of said first tubular shoulder pad is securely attached to said first side harness and said upper end of said second tubular shoulder pad is securely attached to said second side harness.

12. The method of claim 8, wherein the back and neck support becomes curved when the baby adjustment and locking strap assembly is closed prior to lifting said baby carrier with said secured baby so as to provide support for the baby's back and neck during the process of lifting said baby carrier with said secured baby.

13. The baby carrier of claim 1, further comprising:

a first adjustment strap having a first end and a second end, wherein said first end of said baby leg holder's length is disposed at said second end of said first adjustment strap; and a second adjustment strap having a first end and a second end, wherein said second end of said baby leg holder's length is disposed at said second end of said second adjustment strap, wherein operative adjustments of said first and second adjustment strap facilitate a lateral adjustment of said leg holder and control the height and proximity of said baby on said caretaker.

14. The baby carrier of claim 1, wherein the hammock is formed of a totality of material that would not lay flat if laid on a flat surface, the hammock having a magnitude in the third dimension greater than a thickness of the material, the magnitude of the third dimension greatest at the central portion.

15. The baby carrier of claim 1, wherein the first and second shoulder pads are tubular and the first and second ends of the baby leg holder are enabled to enter the respective first and second tubular shoulder pads as a result of the first and second ends being narrowed.

16. The baby carrier of claim 1, wherein a lowermost length of the hammock is free and unsupported along a central portion of said lowermost length, wherein said lowermost length is defined to be a length furthest from the back and neck support when moving along an outer surface of the hammock from an uppermost length adjacent the back and neck support.

17. The baby carrier of claim 2, wherein when the baby sits in the hammock in the second leg position in which the legs are spread, a bottom of the hammock extends further into the third dimension than does the front or rear of the hammock.

18. The baby carrier of claim 1, wherein said back and neck support is made of a flexible flat surface, wherein said back and neck support has a flat form when no bending force is applied on said back and neck support, and wherein said back and neck support operatively carries the bending loads applied on said back and neck support, thereby facilitating back and neck support for said baby.

19. The baby carrier of claim 18, wherein closing and pulling the baby adjustment and locking strap assembly bends the back and neck support.

20. The baby carrier of claim 1 wherein when the baby is loaded in and supported by the baby carrier, both legs of he baby exit from the same side of the hammock.

21. The baby carrier of claim 1 wherein when the baby is loaded in and supported by the baby carrier, the hammock does not separate the legs of the baby.

22. A baby carrier, comprising:

a back and neck support facilitating back, neck and head support for said baby, the back and neck support defining a baby-spine direction and a baby side-to-side direction perpendicular thereto; and a baby leg holder comprising a hammock that is permanently formed between first and second ends thereof, a central axis and a length direction of the hammock being along the baby side-to-side direction and perpendicular to the baby-spine direction, a width-direction of the hammock being along the baby-spine direction, the first end of the hammock to be positioned on one side of a baby and the second end thereof to be positioned on a second side of the baby, the hammock being disposed substantially at the lower end of said back and neck support, the hammock being width-adjustable to adapt to a desired position of the legs of the baby and to cover a variety of sizes and amounts of said baby's bottom and legs, the desired position including a first leg position in which the legs are spread so that the baby's knees are higher than the baby's bottom and a second leg position where the baby's legs are spread to a lesser extent than in the first position, the hammock further being length-adjustable when the baby is carried in and supported by the carrier;

the hammock having a wider central portion and narrower first and second ends, each of the first and second ends connected to respective first and second shoulder pads via respective straps that respectively extend from the first and second ends of the hammock, a closed loop of integrally connected material including the baby leg holder, back and neck support, first shoulder pad and second shoulder pad, the closed loop being structured to enable the caretaker to load a baby into the carrier and hang the carrier with the baby by the shoulder pads before wearing the carrier and to then wear the carrier without assistance from another person by successively inserting the caretaker's arms through the shoulder pads so as, at the option of the caretaker, to carry the baby on a back of the caretaker, or at the option of the caretaker, to carry the baby in front of the caretaker.

* * * * *